US010673178B1

(12) United States Patent
Nakashima et al.

(10) Patent No.: US 10,673,178 B1
(45) Date of Patent: Jun. 2, 2020

(54) TERMINAL BLOCK

(71) Applicants: AUTONETWORKS TECHNOLOGIES, LTD., Yokkaichi-shi, Mie (JP); SUMITOMO WIRING SYSTEMS, LTD., Yokkaichi-shi, Mie (JP); SUMITOMO ELECTRIC INDUSTRIES, LTD., Osaka-shi, Osaka (JP)

(72) Inventors: Kazuo Nakashima, Yokkaichi (JP); Katsufumi Matsui, Yokkaichi (JP); Takashi Kawakami, Yokkaichi (JP)

(73) Assignees: AUTONETWORKS TECHNOLOGIES, LTD., Yokkaichi (JP); SUMITOMO WIRING SYSTEMS, LTD., Yokkaichi (JP); SUMITOMO ELECTRIC INDUSTRIES, LTD., Osaka-Shi, Osaka (JP)

( * ) Notice: Subject to any disclaimer, the term of this patent is extended or adjusted under 35 U.S.C. 154(b) by 184 days.

(21) Appl. No.: 16/076,747

(22) PCT Filed: Feb. 20, 2017

(86) PCT No.: PCT/JP2017/006166
§ 371 (c)(1),
(2) Date: Aug. 9, 2018

(87) PCT Pub. No.: WO2017/154543
PCT Pub. Date: Sep. 14, 2017

(30) Foreign Application Priority Data

Mar. 7, 2016 (JP) ..... 2016-043568

(51) Int. Cl.
*H01R 13/52* (2006.01)
*H01B 1/02* (2006.01)
(Continued)

(52) U.S. Cl.
CPC ..... *H01R 13/5205* (2013.01); *H01B 1/026* (2013.01); *H01R 13/50* (2013.01); *H01R 9/24* (2013.01); *H01R 13/521* (2013.01)

(58) Field of Classification Search
CPC ..... H01R 13/5205
See application file for complete search history.

(56) References Cited

U.S. PATENT DOCUMENTS 9,281,101 B2 * 3/2016 Tachi ..... H01R 43/005
9,722,349 B2 * 8/2017 Ishihara ..... H01R 13/5205
(Continued)

FOREIGN PATENT DOCUMENTS

JP H10294024 A 11/1998
JP 2014053230 A 3/2014

OTHER PUBLICATIONS

International Search Report and Written Opinion for Application No. PCT/JP2017/006166 dated Mar. 21, 2017; 4 pages.

*Primary Examiner* — Ross N Gushi
(74) *Attorney, Agent, or Firm* — Reising Ethington, P.C.

(57) ABSTRACT

A terminal block in which outflow of a sealing portion made of a rubber-based adhesive can be suppressed even when exposed to a heated environment, and the sealing properties can be maintained. The terminal block includes a housing having a resin portion, a bus bar, and the sealing portion. The bus bar integrally includes an embedded portion embedded in the resin portion, and a connecting portion projecting outward from the resin portion. The sealing portion fills a gap between the embedded portion and the resin portion. The sealing portion is made of a rubber-based adhesive. The bus bar includes a base material made of Cu or a Cu alloy, and an Sn-based plated layer made of Sn or an Sn alloy and
(Continued)

partially covering a surface of the base material. The base material is exposed at a sealing region in contact with the sealing portion.

4 Claims, 4 Drawing Sheets

(51) Int. Cl.
*H01R 13/50* (2006.01)
*H01R 9/24* (2006.01)

(56) References Cited

U.S. PATENT DOCUMENTS

| | | | | |
|---|---|---|---|---|
| 9,912,096 | B2 * | 3/2018 | Nomura | H01R 13/03 |
| 10,388,428 | B2 * | 8/2019 | Nakashima | H01B 3/42 |
| 2003/0194608 | A1 * | 10/2003 | Hirai | H01M 2/30 429/178 |
| 2007/0020996 | A1 * | 1/2007 | Kurzeja | H01R 13/03 439/587 |
| 2009/0258521 | A1 | 10/2009 | Ooki | |
| 2016/0028177 | A1 * | 1/2016 | Nomura | H01R 43/16 439/874 |
| 2017/0012370 | A1 * | 1/2017 | Hamaguchi | C09J 123/26 |
| 2019/0006787 | A1 * | 1/2019 | Kawakami | H01R 13/50 |
| 2019/0044257 | A1 * | 2/2019 | Nakashima | H01R 13/521 |
| 2019/0288434 | A1 * | 9/2019 | Hauck | H01R 4/62 |

* cited by examiner

TERMINAL BLOCK

CROSS REFERENCE TO RELATED APPLICATIONS

This application claims the priority of Japanese patent application JP2016-043568 filed on Mar. 7, 2016, the entire contents of which are incorporated herein.

TECHNICAL FIELD

The present invention relates to a terminal block.

BACKGROUND ART

Conventionally, it is known that connector parts to which wire harnesses and the like for automobiles are connected are provided with a sealing portion in order to prevent the intrusion of a liquid such as water or oil. As this type of connector part, for example, terminal blocks including a housing having a resin portion, and a bus bar made of an Sn-plated copper bar or the like are known, wherein the bus bar is fixed to the resin portion through insert molding.

A resin portion in such a terminal block is typically hard to adhere to a bus bar made of metal, and its size is likely to change due to mold shrinkage or the like. Thus, a gap is inevitably formed between the resin portion and the bus bar. Thus, a sealing portion is provided in the gap in order to prevent the intrusion of a liquid such as water or oil. The sealing portion is typically made of a rubber-based adhesive as described in Patent Document 1 (JP2009-252712A), etc.

SUMMARY

However, when such conventional terminal blocks are used in a heated environment at high temperatures for a long period of time, a sealing portion made of a rubber-based adhesive deteriorates due to being heated and softens in accordance with the deterioration. Thus, it may not be possible to maintain the sealing properties of the rubber-based adhesive forming the sealing portion in the gap between the resin portion and the bus bar. Deterioration of rubber-based adhesives needs to be suppressed in order to maintain the sealing properties. However, even when an acid acceptor, a stabilizer, or the like is added, deterioration of some rubber-based adhesives is still accelerated by Sn or other metal ions derived from a bus bar and acting as a catalyst. Thus, it is difficult to suppress the deterioration of rubber-based adhesives due to being heated.

The present disclosure was made in view of the above-mentioned circumstances, and it is an object thereof to provide a terminal block in which outflow of a sealing portion made of a rubber-based adhesive can be suppressed even when exposed to a heated environment, and the sealing properties can be maintained.

An aspect of the present disclosure is directed to a terminal block including: a housing having a resin portion; a bus bar integrally including an embedded portion embedded in the resin portion and a connecting portion projecting outward from the resin portion; and a sealing portion filling a gap between the embedded portion and the resin portion; wherein the sealing portion is made of a rubber-based adhesive, the bus bar includes a base material made of Cu or a Cu alloy, and an Sn-based plated layer made of Sn or an Sn alloy and partially covering a surface of the base material, and the base material is exposed at a sealing region in contact with the sealing portion.

When a rubber-based adhesive deteriorates due to being heated, deterioration of the rubber-based adhesive may be accelerated by Sn, Zn, or other metal ions acting as a catalyst. Furthermore, some components contained in a rubber-based adhesive may react with the metal ions and generate sulfide, oxide, chloride, or the like. These substances may further accelerate deterioration of the rubber-based adhesive.

On the other hand, in a terminal block with a sealing structure configured as described above, a bus bar includes a base material made of Cu or a Cu alloy, and an Sn-based plated layer made of Sn or an Sn alloy and partially covering a surface of the base material, and the base material is exposed at a sealing region in contact with a sealing portion. Thus, according to this terminal block, the sealing portion made of a rubber-based adhesive and the Sn-based plated layer are not in surface contact with each other, and the likelihood that the rubber-based adhesive will react with metal ions and generate sulfide, oxide, chloride, or the like is low even when exposed to a heated environment. As a result, deterioration of the sealing portion and softening in accordance with the deterioration can be suppressed. Thus, according to the above-described terminal block, outflow of the sealing portion made of a rubber-based adhesive can be suppressed even when exposed to a heated environment, and the sealing properties can be maintained.

DESCRIPTION OF EMBODIMENTS

Figure 1:
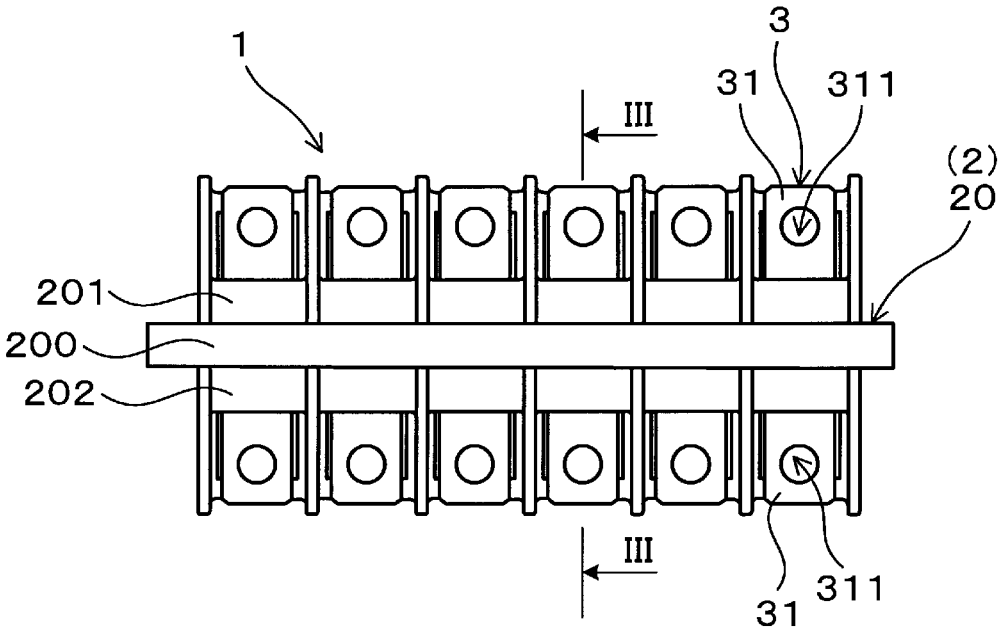
FIG. 1 is a front view of a terminal block of Example 1.
Figure 2:
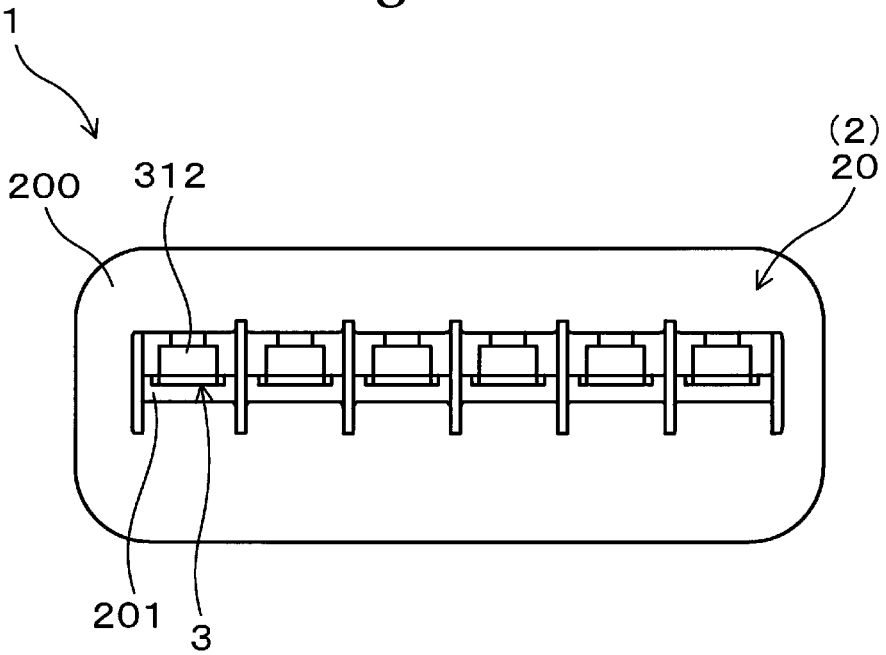
FIG. 2 is a plan view of the terminal block of Example 1.

In the above-described terminal block, the sealing portion is made of a rubber-based adhesive. Specifically, the sealing portion can be made of an epichlorohydrin rubber-based adhesive, a butyl rubber-based adhesive, a chloroprene rubber-based adhesive, or the like. More specifically, the sealing portion can be made of a crosslinkable polymer of an adhesive composition containing epichlorohydrin rubber, a crosslinkable polymer of an adhesive composition containing butyl rubber, a crosslinkable polymer of an adhesive composition containing chloroprene rubber, or the like, as a rubber component.

Examples of the epichlorohydrin rubber include epichlorohydrin homopolymer rubber, binary or higher copolymer rubber having epichlorohydrin unit and alkylene oxide unit, and a combination thereof. Specifically, examples of the copolymer rubber include epichlorohydrin-ethylene oxide copolymer rubber, and epichlorohydrin-ethylene oxide-allyl glycidyl ether copolymer rubber. Of these epichlorohydrin rubbers, epichlorohydrin homopolymer rubber is preferable in terms of versatility, cost, and the like.

The adhesive composition may further contain, for example, rubber components such as nitrile rubber, acryl rubber, epichlorohydrin rubber (in the case of a butyl rubber-based adhesive or a chloroprene rubber-based adhesive), butyl rubber (in the case of an epichlorohydrin rubber-based adhesive or a chloroprene rubber-based adhesive), and chloroprene rubber (in the case of an epichlorohydrin rubber-based adhesive or a butyl rubber-based adhesive). Furthermore, the adhesive composition may contain one or two or more additives such as a vulcanizing agent (including vulcanization accelerators), a plasticizer, a lubricant, an acid acceptor, a stabilizer, an anti-aging agent, a mastication accelerator or the like.

In the above-described terminal block, the bus bar has a base material made of Cu or a Cu alloy, and an Sn-based plated layer made of Sn or an Sn alloy and partially covering a surface of the base material, and the base material is exposed at the sealing region in contact with the sealing portion (hereinafter, this portion may also be referred to as a "base material exposed portion"). That is to say, no Sn-based plated layer is formed in the sealing region of the bus bar. Basically, the portions of the bus bar other than the sealing region may be covered by an Sn-based plated layer. Note that, as long as conduction is not disturbed, the base material may be exposed at portions of the bus bar other than the sealing region. It will be appreciated that the entire connecting portion of the bus bar projecting outward from the resin portion is preferably covered by an Sn-based plated layer. The reason for this is that a terminal block with reliable conduction and an excellent appearance can be obtained.

In the above-described terminal block, specifically, the surface area of the base material exposed portion in the bus bar may be the same as the surface area of the sealing region in the bus bar, or may also be larger than the surface area of the sealing region in the bus bar. In the latter case, it is possible to further reliably suppress the situation in which sulfide, oxide, or chloride generated through a reaction with metal ions comes into contact with the sealing portion, and thus deterioration of the sealing portion can be easily suppressed. It will be appreciated that, in order to obtain a terminal block that is excellent in terms of appearance and the like, the surface area of the base material exposed portion in the bus bar may be smaller than the surface area of the embedded portion forming region in the bus bar. Accordingly, a configuration can be obtained in which the base material exposed portion in the bus bar is located inside the embedded portion in the bus bar and is not located at the connecting portions in the bus bar.

In the above-described terminal block, the resin portion can be made of, for example, a thermoplastic resin containing glass fibers. In this case, the resin portion can be insert-molded, and the thermal resistance of the insert-molded resin portion is improved. Thus, in combination with the effect that the sealing properties can be maintained even when exposed to a heated environment, it is possible to obtain a terminal block that is excellent in terms of thermal resistance.

Specific examples of the thermoplastic resin preferably include an aromatic polyamide resin and the like. An aromatic polyamide resin contains an aromatic compound in its molecular framework, and thus has a higher thermal resistance compared with an aliphatic polyamide resin. Thus, in this case, it is possible to obtain a terminal block that easily achieves the above-described effects.

The above-described terminal block can be preferably used, for example, to connect a wire harness for an automobile. In this case, the terminal block can be more specifically used, for example, to connect a high-voltage wire harness for an electric vehicle, a hybrid car, a fuel cell vehicle, or the like.

The above-described terminal block can be produced, for example, as follows. Note that the method for producing the above-described terminal block is not limited to the description below.

A bus bar is prepared in which no Sn-based plated layer is formed at a predetermined portion where a sealing portion is to be formed, and the base material is exposed at that portion, and the base material is covered by an Sn-based plated layer at portions other than the predetermined portion where a sealing portion is to be formed. Note that Cu or a Cu alloy is used for the base material. Then, an adhesive composition containing rubber such as epichlorohydrin rubber is applied to the bus bar at the predetermined portion where a sealing portion is to be formed. As necessary, after application, the adhesive composition may be dried. Then, the adhesive composition applied to the bus bar is heated, and thus the adhesive composition is crosslinked. Then, the bus bar and the resin portion are integrated through insert molding. Accordingly, a sealing portion is formed so as to fill a gap between the embedded portion of the bus bar and the resin portion. Accordingly, the above-described terminal block is obtained. Note that the adhesive composition may also be crosslinked using heat during insert molding.

Note that in order to obtain the above-described actions and effects or the like, the above-described configurations may be used in combination as necessary.

EXAMPLES

Below, examples of the terminal block will be described with reference to the drawings.

Example 1

Hereinafter, a terminal block of Example 1 will be described with reference to FIGS. 1 to 7. As shown in FIGS. 1 to 7, a terminal block 1 of this example includes a housing 2 having a resin portion 20, bus bars 3, and a sealing portion 4. Each bus bar 3 integrally includes an embedded portion 30 embedded in the resin portion 20, and connecting portions 31 projecting outward from the resin portion 20. The sealing portion 4 fills a gap 5 formed between the embedded portion 30 and the resin portion 20. Details will be given below.

In this example, the resin portion 20 is made of a thermoplastic resin containing glass fibers. Specifically, the thermoplastic resin is an aromatic polyamide resin (aromatic nylon resin). Specifically, the resin portion 20 includes a bar-like base portion 200, a plurality of first projecting portions 201 projecting outward from a face of the base portion 200 on the first connection side, a plurality of second projecting portions 202 projecting outward from a face of the base portion 200 on the second connection side at positions corresponding to the first projecting portions 201, and a plurality of bus bar holding openings 203 extending through the base portion 200, the first projecting portions 201, and the second projecting portions 202.

In this example, specifically, the sealing portion 4 is arranged at a part of the gap 5 formed between the surface of the embedded portion 30 and the inner wall face of the bus bar holding openings 203 of the resin portion 20. More specifically, the sealing portion 4 is arranged on the embedded portion 30 at a position corresponding to the base portion 200. Furthermore, the sealing portion 4 is provided so as to surround the outer perimeter of the bus bar 3 in a part of the embedded portion 30.

The sealing portion 4 is made of a rubber-based adhesive. Specifically, the rubber-based adhesive may be an epichlorohydrin rubber-based adhesive, a chloroprene rubber-based adhesive, or a butyl rubber-based adhesive. The width of the sealing portion 4 is specifically 2.5 mm. The thickness of the sealing portion 4 is specifically 200 am.

Figure 3:
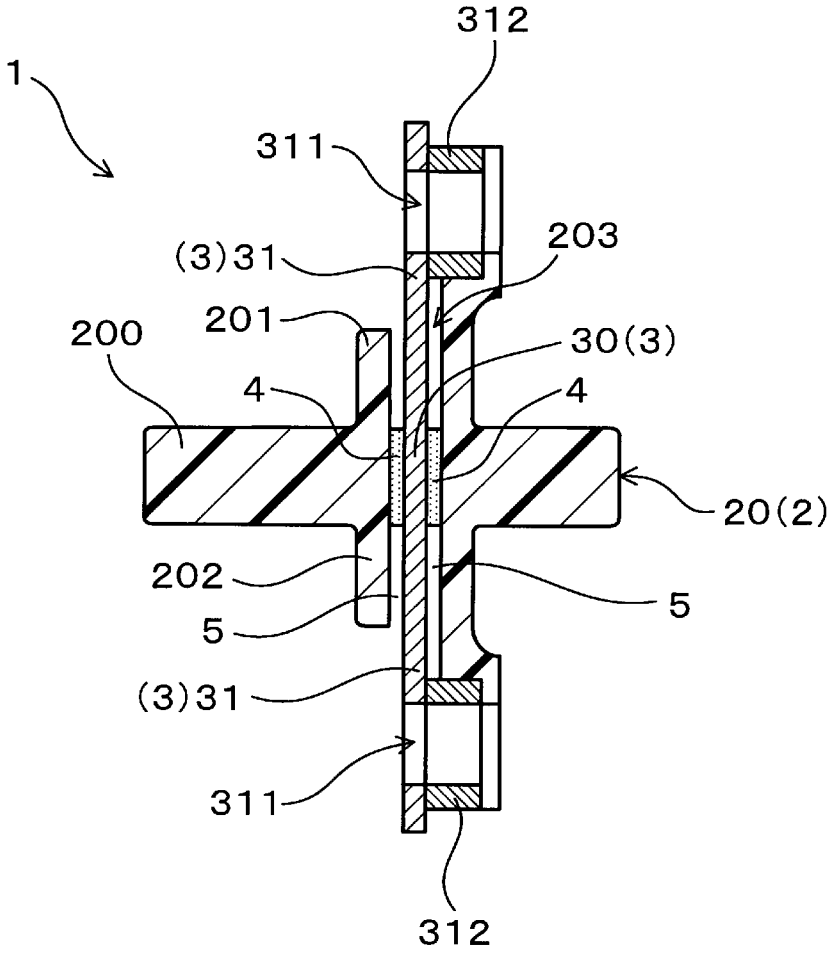
FIG. 3 is a cross-sectional view taken along III-III in FIG. 1.
Figure 4:
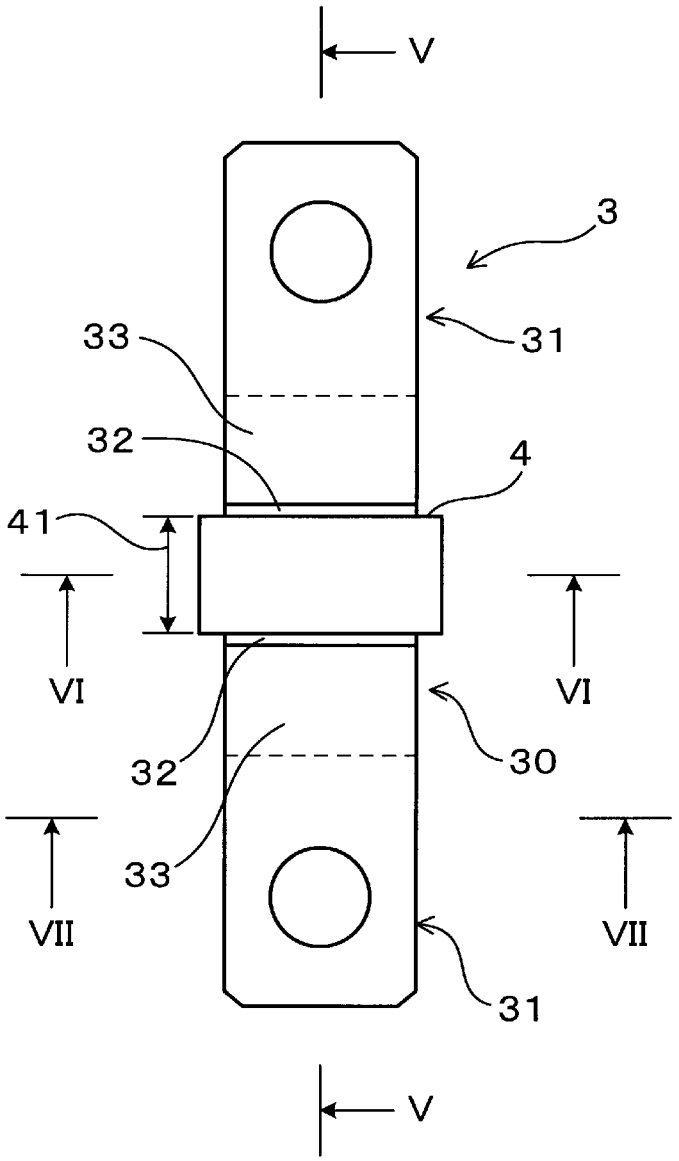
FIG. 4 is an explanatory view showing a bus bar and a sealing portion included in the terminal block of Example 1.
Figure 5:
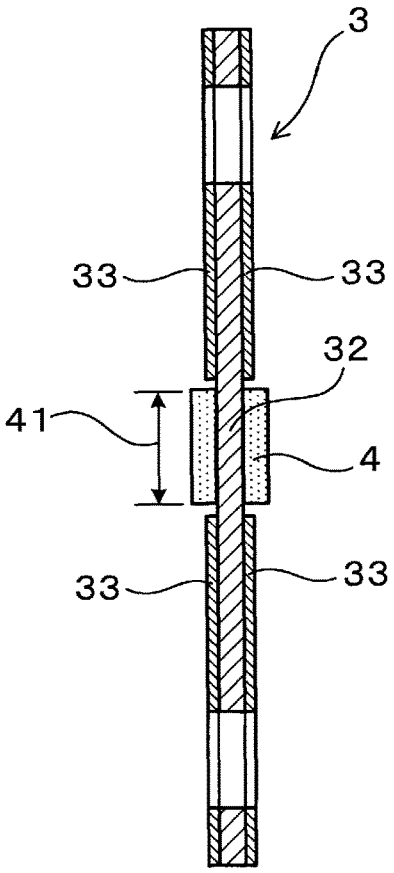
FIG. 5 is a cross-sectional view taken along V-V in FIG. 4.
Figure 6:
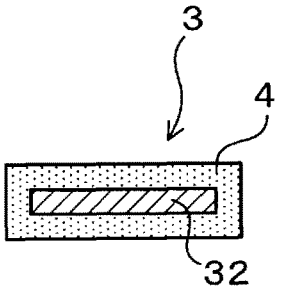
FIG. 6 is a cross-sectional view taken along VI-VI in FIG. 4.
Figure 7:
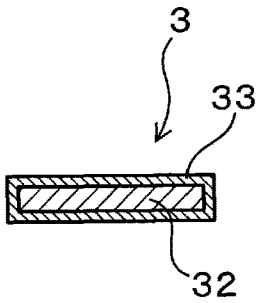
FIG. 7 is a cross-sectional view taken along VII-VII in FIG. 4.

Furthermore, as shown in FIGS. 4 to 7, the bus bar 3 includes a base material 32 made of Cu or a Cu alloy, and an Sn-based plated layer 33 made of Sn or an Sn alloy and partially covering a surface of the base material 32. In FIG. 3, a detailed configuration of the bus bar 3 has been omitted.

In this example, specifically, the bus bar 3 is in the shape of a bar. The bus bar 3 is fixed to the resin portion 20 through insert molding. Specifically, the bus bar 3 is fixed to the resin portion 20 in a state of extending through the bus bar holding openings 203 of the resin portion 20. The portion of the bus bar 3 arranged inside the bus bar holding openings 203 is referred to as the embedded portion 30. Meanwhile, the portions of the bus bar 3 exposed outward from the bus bar holding openings 203 are referred to as the connecting portions 31. Accordingly, in this example, the bus bar 3 has the connecting portions 31 respectively at both ends of the embedded portion 30. The connecting portions 31 include fastening holes 311 and fastening nuts 312 for fastening a wire harnesses or the like. Note that the drawings show an example in which a plurality of (specifically, six) bus bars 3 are arranged so as to be spaced away from each other.

The bus bar 3 is such that the base material 32 is exposed at a sealing region 41 in contact with the sealing portion 4. That is to say, no Sn-based plated layer 33 is provided in the sealing region 41 of the bus bar 3. The portions (corresponding to part of the embedded portion 30 and the connecting portions 31, in this example) of the bus bar 3 other than the sealing region 41 are covered by the Sn-based plated layer 33. In this example, the surface area of the base material exposed portion in the bus bar 3 is larger than the surface area of the sealing region 41 in the bus bar 3.

Next, actions and effects of the terminal block according to this example will be described.

When an epichlorohydrin rubber-based adhesive or a chloroprene rubber-based adhesive forming the sealing portion 4 deteriorates due to being heated, a part of the Sn-based plated layer 33 on the surface of the bus bar 3 generates tin chloride. When tin chloride is present, deterioration of the rubber-based adhesive due to being heated is accelerated. In particular, when the sealing portion 4 is covered by the resin portion 20, tin chloride is likely to be generated, and the deterioration of the sealing portion 4 is further accelerated. Furthermore, when the sealing portion 4 is made of a butyl rubber-based adhesive, oxidative deterioration of the butyl rubber due to metal ions is accelerated.

On the other hand, according to the terminal block 1 of this example, the bus bar 3 includes the base material 32 made of Cu or a Cu alloy, and the Sn-based plated layer 33 made of Sn or an Sn alloy and partially covering a surface of the base material, and the base material 32 is exposed at the sealing region 41 in contact with the sealing portion 4. Thus, according to the terminal block 1, the sealing portion 4 made of a rubber-based adhesive and the Sn-based plated layer 33 are not in surface contact with each other, and thus, even when exposed to a heated environment, deterioration of the sealing portion 4 and softening in accordance with the deterioration can be suppressed. Thus, according to the terminal block 1, outflow of the sealing portion 4 made of an epichlorohydrin rubber-based adhesive can be suppressed even when exposed to a heated environment, and the sealing properties can be maintained.

EXPERIMENTAL EXAMPLES

Hereinafter, more details will be given with reference to experimental examples.

Preparation of Rubber-Based Adhesive Material

The following materials were prepared as materials for the epichlorohydrin rubber-based adhesive composition.

- Epichlorohydrin rubber (epichlorohydrin homopolymer rubber) (manufactured by Daiso Co., Ltd., "Epichlomer H")
- Vulcanizing agent (1) (triazine-based vulcanizing agent, 2,4,6-trimercapto-s-triazine) (manufactured by Kawaguchi Chemical Industry Co., Ltd., "Actor TSH")
- Vulcanizing agent (2) (thiourea-based vulcanizing agent) (manufactured by Kawaguchi Chemical Industry Co., Ltd., "Accel 22-S")
- Vulcanizing agent (3) (polysulfide-based vulcanizing agent) (manufactured by Sanshin Chemical Industry Co., Ltd., "Sanfel EX")
- Lubricant (stearic acid) (manufactured by Kao Corporation, "Lunac S-70V")
- Acid acceptor (magnesium oxide) (manufactured by Konoshima Chemical Co., Ltd., "CX150")
- Stabilizer (for HCl scavenging, epoxy resin) (manufactured by Adeka Corporation, "EP-4400")
- Solvent (toluene) (manufactured by Wako Pure Chemical Industries, Ltd.)

The materials were mixed to predetermined mixed ratios shown in Table 1 below, and thus epichlorohydrin rubber-based adhesive compositions for forming sealing portions of terminal blocks were obtained. Furthermore, the following materials were prepared as the butyl rubber-based adhesive composition and the chloroprene rubber-based adhesive composition.

- Butyl rubber-based adhesive composition (manufactured by Hitachi Chemical Company, Ltd., "Hi-Bon 1010A")
- Chloroprene rubber-based adhesive composition (manufactured by 3M Japan Limited, "EC-1368NT")

Bus Bar

The following materials were prepared as a bus bar.

- Bus bar made of an entirely Sn-plated copper bar in which the entire surface of a copper base material is plated with Sn (hereinafter, also referred to as an "entirely Sn-plated bus bar")
- Bus bar made of a partially Sn-plated copper bar in which an adhesive composition application position (the portion for forming into a sealing region in contact with a sealing portion that is formed) of an embedded portion embedded in the resin portion is not Sn-plated and a copper base material is exposed thereat, and the other portions of the surface of the copper base material are Sn-plated (hereinafter, also referred to as a "partially Sn-plated bus bar").

Production of Terminal Block

Terminal blocks of Test Samples 1 to 7 and terminal blocks of Test Samples 1C to 7C including a sealing portion made of a crosslinkable polymer of an adhesive composition shown in Table 1 and bus bar were produced as defined in Example 1. Specifically, a predetermined adhesive composition was applied to a predetermined portion of the bus bar at which a sealing portion was to be formed, and was dried. Then, the adhesive composition applied to the bus bar was heated, and thus the adhesive composition was crosslinked.

Then, the bus bar and the resin portion were integrated through insert molding. Accordingly, a sealing portion was formed so as to fill a gap between the embedded portion of the bus bar and the resin portion. Note that a partially Sn-plated bus bar was used in each of the obtained terminal blocks of Test Samples 1 to 7. Thus, the sealing portion of each terminal block of Test Samples 1 to 7 was in surface contact with the base material exposed portion of the partially Sn-plated bus bar, and was not in surface contact with the Sn plated layer. On the other hand, an entirely Sn-plated bus bar was used in each of the terminal blocks of Test Samples 1C to 7C. Thus, the sealing portion of each terminal block of Test Samples 1C to 7C was in surface contact with the Sn plated layer of the entirely Sn-plated bus bar.

Evaluation of Sealing Properties Under Heated Environment

A leak test was carried out as follows in order to evaluate the sealing properties of the sealing portion in each of the produced terminal blocks.

Leak Test after Heating

Each terminal block was subjected in advance to heating under the conditions of being heated at 150° C. for 1000 hours, at 150° C. for 1500 hours, or at 150° C. for 2000 hours. Then, compressed air at 100 kPa was introduced into the terminal block after treatment, from an open end of a bus bar holding opening on the first connection side. Then, it was seen whether or not the compressed air leaked out of an open end of the bus bar holding opening on the second connection side.

Leak Test after Heat Cycles

Each terminal block was subjected in advance to heat cycles under the conditions of being held at −40° C. for 2 hours and then held at 150° C. for 2 hours, the cycles being repeated 500 times or 1000 times. Then, compressed air at 100 kPa was introduced into the terminal block after treatment, from an open end of a bus bar holding opening on the first connection side. Then, it was seen whether or not the compressed air leaked out of an open end of the bus bar holding opening on the second connection side.

Table 1 summarizes detailed compositions of the adhesive compositions, the types of bus bars, and results of various evaluations.

TABLE 1

| | | | Test Sample | | | | | | |
|---|---|---|---|---|---|---|---|---|---|
| | | | 1 | 2 | 3 | 4 | 5 | 6 | 7 |
| Sealing portion | Adhesive composition (pats by weight) | Epichlorohydrin rubber | 100 | 100 | 100 | 100 | 100 | — | — |
| | | Vulcanizing agent (1) | 0.3 | 5 | — | — | — | — | — |
| | | Vulcanizing agent (2) | — | — | 1 | 1 | — | — | — |
| | | Vulcanizing agent (3) | — | — | — | — | 1 | — | — |
| | | Lubricant | 3 | 3 | 3 | 3 | 3 | — | — |
| | | Acid acceptor | 2 | 2 | 2 | 1 | 0 | — | — |
| | | Stabilizer | 2 | 2 | 2 | 0 | 0 | — | — |
| | | Solvent | 210 | 210 | 210 | 210 | 210 | — | — |
| | | Butyl rubber-based adhesive composition | — | — | — | — | — | 100 | — |
| | | Chloroprene rubber-based adhesive composition | — | — | — | — | — | — | 100 |
| Sn-plating of bus bar | | | Part | Part | Part | Part | Part | Part | Part |
| Leak test | After heating | | | | | | | | |
| | | 150° C. × 1000 h | None | None | None | None | None | None | None |
| | | 150° C. × 1500 h | None | None | None | None | None | None | Treated |
| | | 150° C. × 2000 h | None | None | None | None | None | Treated | Treated |
| | After heat cycles | | | | | | | | |
| | | −40° C.↔150° C., 2 h each, 500 cycles | None | None | None | None | None | None | None |
| | | −40° C.↔150° C., 2 h each, 1000 cycles | None | None | None | None | None | Treated | Treated |

| | | | Test Sample | | | | | | |
|---|---|---|---|---|---|---|---|---|---|
| | | | 1C | 2C | 3C | 4C | 5C | 6C | 7C |
| Sealing portion | Adhesive composition (pats by weight) | Epichlorohydrin rubber | 100 | 100 | 100 | 100 | 100 | — | — |
| | | Vulcanizing agent (1) | 0.3 | 5 | — | — | — | — | — |
| | | Vulcanizing agent (2) | — | — | 1 | 1 | — | — | — |
| | | Vulcanizing agent (3) | — | — | — | — | 1 | — | — |
| | | Lubricant | 3 | 3 | 3 | 3 | 3 | — | — |
| | | Acid acceptor | 2 | 2 | 2 | 3 | 0 | — | — |
| | | Stabilizer | 2 | 8 | 2 | 8 | 0 | — | — |
| | | Solvent | 210 | 210 | 210 | 210 | 210 | — | — |
| | | Butyl rubber-based adhesive composition | — | — | — | — | — | 100 | — |

TABLE 1-continued

| | | | | | | | | | |
|---|---|---|---|---|---|---|---|---|---|
| | | Chloroprene rubber-based adhesive composition | — | — | — | — | — | — | 100 |
| Sn-plating of bus bar | | | Entire | Entire | Entire | Entire | Entire | Entire | Entire |
| Leak test | After heating | | | | | | | | |
| | | 150° C. × 1000 h | None | None | None | None | Treated | Treated | Treated |
| | | 150° C. × 1500 h | None | None | Treated | None | Treated | Treated | Treated |
| | | 150° C. × 2000 h | Treated | Treated | Treated | Treated | Treated | Treated | Treated |
| | After heat cycles | | | | | | | | |
| | | −40° C.↔150° C., 2 h each, 500 cycles | None | None | Treated | None | Treated | Treated | Treated |
| | | −40° C.↔150° C., 2 h each, 1000 cycles | Treated | Treated | Treated | Treated | Treated | Treated | Treated |

The following aspects are seen from Table 1. That is to say, according to the terminal blocks of Test Samples 1C to 7C, the sealing portion made of a rubber-based adhesive was in surface contact with the Sn plated layer of the entirely Sn-plated bus bar. Thus, when the terminal blocks of Test Samples 1C to 7C were used in a heated environment at high temperatures for a long period of time, deterioration of the sealing portion and softening in accordance with the deterioration could not be suppressed, and the sealing properties could not be maintained. Note that it is seen from the results of Test Samples 2C and 4C that it was difficult to suppress deterioration due to being heated during use in a heated environment at high temperatures for a long period of time even when the amount of additives such as an acid acceptor or a stabilizer added to the epichlorohydrin rubber-based adhesive was increased.

On the other hand, according to the terminal blocks of Test Samples 1 to 7, the sealing portion made of a rubber-based adhesive was in surface contact with the copper base material of the partially Sn-plated bus bar. Thus, even when the terminal blocks of Test Samples 1C to 7C were used in a heated environment at high temperatures for a long period of time, deterioration of the sealing portion and softening in accordance with the deterioration could be suppressed, and the sealing properties could be maintained.

Although an example of the present invention was described in detail above, the present invention is not limited in any way to the foregoing example, and various modifications can be made without departing from the gist of the present invention.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A terminal block comprising:

a housing having a resin portion; a bus bar integrally including an embedded portion embedded in the resin portion and a connecting portion projecting outward from the resin portion;

and a sealing portion filling a gap between the embedded portion and the resin portion;

wherein the sealing portion is made of a rubber-based adhesive, the bus bar includes a base material made of Cu or a Cu alloy, and an Sn-based plated layer made of Sn or an Sn alloy and partially covering a surface of the base material, and the base material is exposed at a sealing region in contact with the sealing portion.

2. The terminal block according to claim 1, wherein the resin portion is made of a thermoplastic resin containing glass fibers.

3. The terminal block according to claim 2, wherein the thermoplastic resin is an aromatic polyamide resin.

4. The terminal block according to claim 1, capable of being used for connecting a wire harness for an automobile.

* * * * *